United States Patent [19]

Bertucci et al.

[11] Patent Number: 5,055,380

[45] Date of Patent: Oct. 8, 1991

[54] METHOD OF FORMING A COLOR-DIFFERENTIATED IMAGE UTILIZING A METASTABLE AGGREGATED GROUP IB METAL COLLOID MATERIAL

[75] Inventors: Sidney J. Bertucci; Hugh S. A. Gilmour, both of Rochester, N.Y.

[73] Assignee: Eastman Kodak Company, Rochester, N.Y.

[21] Appl. No.: 452,534

[22] Filed: Dec. 18, 1989

[51] Int. Cl.[5] ..... G03C 5/00; G03C 1/494; G03C 1/00

[52] U.S. Cl. ..... 430/346; 430/270; 430/290; 430/292; 430/363; 430/495; 430/496; 430/542; 430/567; 430/945

[58] Field of Search ..... 430/346, 363, 290, 945, 430/495, 270, 292, 502, 542, 567, 496; 346/76 PH, 76 L, 135.1

[56] References Cited

U.S. PATENT DOCUMENTS 4,120,728 10/1978 Ikenoue ..... 430/618
4,459,353 7/1984 Maskasky ..... 430/569
4,837,134 6/1989 Bouldin ..... 430/346
4,849,319 7/1989 Inoue ..... 430/949

OTHER PUBLICATIONS

Defensive Publication T-900,010.

"Carey Lea's Colloidal Silver" by Frens et al., Kolloid-Zeitschrift und Zeutschrift fur Polymers, Band 233-Heft 1-2.

*Primary Examiner*—Charles L. Bowers, Jr.
*Assistant Examiner*—Christopher G. Young
*Attorney, Agent, or Firm*—Oblon, Spivak, McClelland, Maier & Neustadt

[57] ABSTRACT

An aggregated-Group Ib metal colloid is prepared, which may be used to form stable color-differentiated images, by the selective application of thermal energy thereto. The metal aggregates, when exposed to thermal energy, revert either to the unaggregated metal or to an aggregate of lesser dimension. This change induces a color change in the material, which is clearly visible against those areas not so exposed. The metal aggregates, when dispersed in a polymeric matrix, are stable in the absence of heat.

14 Claims, No Drawings

METHOD OF FORMING A COLOR-DIFFERENTIATED IMAGE UTILIZING A METASTABLE AGGREGATED GROUP IB METAL COLLOID MATERIAL

BACKGROUND OF THE INVENTION

1. Field of the Invention

The invention pertains to a method of forming images from metastable aggregated-metal colloids, and materials prepared therefrom. In particular, a coating of an aggregated-metal in a polymer matrix may be caused to undergo a color change by the application of thermal energy, to create a permanent image. Selective application of thermal energy can be used to provide a color image on a color differentiated background.

2. Background of the Prior Art

The preparation of stable colloids or hydrosols of metallic silver and gold has been known for some time. One method of preparation of the same is set forth in Frens, G. and Overbeek, J., Kolloid Z. Z. Polym., 233, 922 (1969). Such colloids are characteristically colored. Primary colloids of spherical silver particles, for example, in which the silver is dispersed as separated particles of nonaggregated spheres of silver, are yellow. The use of such colloids in photographic systems as blue light filters is known.

It is also known that the addition of an electrolyte to the colloid, per se, will induce the primary, non-aggregated particles to aggregate as shown by the Frens and Overbeek article referenced above. As the aggregate adds more and more of the primary particles, the observed color of the colloid changes. In the case of silver, the color changes from yellow to red, green, violet, blue, brown and gray. Eventually, if aggregation continues, the aggregates fall out of suspension and precipitate.

In U.S. Pat. application Ser. No. 344,949, *Gilmour et. al.* and U.S. Pat. application Ser. No. 344,950, *Shuman*, both filed Apr. 28, 1989, metastable Group Ib metal colloids, their preparation, and use in thermally forming stable images, is disclosed. In those applications, non-spherical silver or related Group Ib metal colloids are converted to the spherical, yellow form by application of thermal energy. In those applications, the metal particles remain nonaggregated, and the background color changes to the yellow of the spherical particle. This change is induced by a thermal recrystallization, leading to the stable spherical colloidal form, and a different color. The accompanying color change is not related to any aggregation process.

Defensive Publication T900,010 relates to blue colloidal silver and its use in obtaining an image by contacting the blue silver with halide ions to cause the blue silver to recrystallize to a yellow form. No mention is made in this publication of the use of thermal energy to cause imaging in a metastable aggregated-metal colloid system.

Accordingly, it remains a goal of those of skill in the art to provide methods for forming color-differentiated stable images, particularly for use in conjunction with optical reading devices. Ideally, the material should be stable over time, and relatively insensitive to ambient conditions, but, upon conversion, should give a stable, highly-resolved image on a differentiated background.

SUMMARY OF THE INVENTION

An element for forming a color-differentiated image in accordance with the invention comprises a support having thereon a metastable aggregated-metal colloid comprised of discrete aggregations of particles of a Group Ib metal dispersed in a polymeric matrix, the aggregates having a color different from that of the particles in non-aggregated form.

Colloids of aggregated metal particles, specifically Group Ib metals, and exemplary among those, silver, can be prepared by conventional processes. Such aggregated-metal colloids are stabilized, or at least made resistant to further aggregation, such as by the presence of a polymeric material, such as gelatin.

Mixtures of preformed metal aggregates or aggregates of a mixture of two or more metals may be expected to be useful as a metastable colloid to provide an enhanced range of colors.

The aggregated material can be caused to "deaggregate" or reduce the number of particles in and size of the average aggregate, by the application of thermal energy. The aggregated-metal colloid, when thermal energy is selectively applied thereto, will change color, either to the yellow color of the unaggregated material in the case of silver, or to the color of a less aggregated silver colloid in controlled fashion. By selectively altering the level of energy applied, a variety of colors can be formed on a single image. Thus, stable, color-differentiated images can be formed by the imagewise application of thermal energy in the presence of a stabilizing polymeric material.

The images can be formed by devices employing thermal energy, e.g., a laser, high-intensity flash or resistive thermal head.

Once the stable, color-differentiated image is formed, further protection and stabilization of the image may be achieved by a variety of physical means, if in fact the imaging material itself is not already protected, as in Example 1 below. Thus, lamination, and a variety of protective overcoats, may be used.

As noted, given the highly resolved nature of the image, the color-differentiated image prepared according to the invention can be employed for a variety of applications, including projection slides, reflection prints, identification-security cards, barcoded devices, etc.

The relative amount of metal material and polymer employed is not a limiting feature of the invention. In general, sufficient metal must be present to give a uniform color, both to the background and to the area exposed to the thermal energy. A preferred range of polymeric matrix to metal is 10:1 to 1:1.

DETAILED DESCRIPTION OF THE INVENTION

The aggregated metal colloids of this invention are prepared according to well known processes. As noted previously, the aggregated colloid can be caused to go through a variety of color changes, corresponding to increasingly larger aggregations, until the aggregations no longer remain in suspension. This can be easily achieved by the addition of a wide variety of electrolytes.

Once the aggregated colloid, in the desired color, is prepared, it may be rendered "stable", more properly metastable, to ambient conditions by the addition of a polymeric matrix. A preferred matrix is gelatin; e.g., deionized bone gelatin, but other polymers may be used. Given the aqueous nature of the colloid preparation, the addition of hydrophilic polymers, either synthetic or natural, is preferred.

The term "metastable" as used herein has its conventional meaning in describing a material which is capable of existing in two states and being converted from one state to another by application of energy.

The metastable preparation can be coated on any of a variety of supports, the selection of the support being made in view of the imaging medium selected. As exemplary supports, clear or colored plastic films, such as polyethylene terephthalate may be mentioned. The coating may be applied to one or both sides. The coating technique is conventional, and may be achieved using a doctor blade, or other conventional coating technologies. A subbing layer may be introduced between the support and the metastable preparation, where necessary.

The metal to be selected for use in this invention is selected from Group Ib. Among exemplary metals, silver is preferred. Other metals that may be suitably used include gold and copper. Of course, as the metal choice changes, the color of the unaggregated metal particle, and aggregated colloids, will change. As the differentiated background for the image, each of the metals will provide a variety of aggregates with differing colors, based on the degree of aggregation. As aggregation increases, the color of the aggregation, regardless of the metal selected, tends to turn to brown, gray and black, until the aggregate grows so large that it precipitates from solution. Various electrolytes can be employed to induce the aggregation phenomenon. Again, this selection of a particular electrolyte will vary with the selection of a particular metal. In general, various electrolytes can be selected such as sodium carbonate, magnesium nitrate, sodium dihydrogen phosphate, sodium nitrate or potassium carbonate.

This invention may be more fully understood by reference to examples of the preparation of the metastable silver colloid complex, and examples creating color-differentiated images thereon, which follow. cl Preparation of a Metastable Aggregated Silver Colloid The preparation of a metastable metal colloid consisting of aggregated-silver particles is described; it is a variant of the method described by Frens and Overbeek referred to above.

Freshly prepared ferrous sulfate heptahydrate solution (2.5 mL of 300 g/L) was mixed with sodium citrate dihydrate solution (3.5 mL of 400 g/L) and added with vigorous stirring to a solution of silver nitrate (2.5 mL of 100 g/L). The resulting blue-black solid was separated by centrifugation and redispersed in water (5 mL) to yield a red colloid. This red colloid was reflocculated by the addition of a sodium nitrate solution (5 mL of 85 g/L) and the blue-black solid was again separated by centrifugation. The redispersion-reflocculation procedures were repeated two more times after which the blue-black solid was redispersed in water (10 mL) and centrifuged to separate any undesirable large material.

The top portion (about 80 percent of the volume) of the supernate was collected and mixed with gelatin (4.3 mL of deionized bone gel in water (125 g/L).

EXAMPLE 1

Coating Preparation and Imaging.

This example describes the preparation of two metastable aggregated-silver colloid coatings and their use in imaging with a thermal print-head.

Two coatings were prepared:

A. Aggregated-silver (0.23 g/m$^2$) in deionized bone gelatin (2.7 g/m$^2$) (prepared as described above) and nonylphenoxypolyglycidol (0.06 g/m$^2$) were coated on a 175 micrometer thick polyethylene terephthalate support.

B. On a 175 micrometer thick polyethylene terephthalate support a subbing layer of gelatin (6.5 g/m$^2$), sodium bis-2-ethylhexylsulfosuccinate (0.11 g/m$^2$) and bis(vinylsulfonyl)methane (0.34 g/m$^2$) was coated. On top of this layer, a second layer of aggregated-silver (0.27 g/m$^2$) in deionized bone gelatin (1.1 g/m$^2$) (prepared as described above), sodium bis-2-ethylhexylsulfosuccinate (0.06 g/m$^2$) and bis(vinylsulfonyl)methane (0.06 g/m$^2$) were coated.

A TDK (Japan) Inc. ® Model L231 thermal printing head rated at 532 ohms and 23.3 volts was used for imaging. The head was energized with a power supply set at 26 volts when exposing at the maximum power of a stepped tablet exposure.

The procedure for making the images was as follows. The aggregated-silver coating was covered with a 3 μm thick sheet of polyethylene terephthalate. The outer surface of this assemblage was sprayed with Dow Corning ® Lubricant 316 Silicone Release Spray until the surface was slippery to the touch. This cover and lubricant surface provided physical protection for the imaging layer of the invention, and enabled the assemblage to slide past the heated thermal print-head without sticking.

The assemblage was inserted into the nip between the thermal printing head and a powered rubber platten roller. The force exerted over the contact length of 10.5 cm was 8 lb. The assemblage was moved through the nip at 0.25 cm per second by rotation of the powered platten roller. All the elements of the print-head were simultaneously supplied with the same voltage, and the power was periodically reduced to provide a stepped pattern in power (thermal energy) which caused a corresponding stepped density and color image.

Status A red, green and blue densities were read in a non-image region, and in the region of maximum imaging. The differences in density were also tabulated. The data below indicated that differential thermal imaging on a residual colored background was obtained.

| Coating | | Status A Density | | |
|---|---|---|---|---|
| | | Initial | Heated | Δ |
| A | R | 0.3 | 0.9 | +0.6 |
| | G | 1.9 | 1.9 | 0 |
| | B | 3.6 | 3.1 | −0.5 |
| B | R | 0.7 | 0.6 | −0.1 |
| | G | 1.7 | 1.3 | −0.4 |
| | B | 3.0 | 2.9 | −0.1 |

EXAMPLE 2

This example describes the use of metastable aggregated-silver colloid coatings in laser imaging.

An aggregated-silver coating, B, was prepared as described in Example 1.

The aggregated-silver coating was placed on a chrome-plated drum of 22.1 cm diameter rotating at 120 rpm The beam of a Spectra Physics® 2000 Argon Laser having its major emission line at 515 nm was focused onto the surface of the coating to write a helical pattern with a 50 micrometer pitch. The power output was measured with a Coherent Model 212 Laser Power Meter®, with sensor placed in the beam just before the last concave glass focussing lens. The power of the laser spot was adjusted by varying the optical density of filters in the beam and the power supplied to the laser. The lower power level caused the color of the aggregated-silver coating to change from brown to green, and the higher power level generated a yellow or colorless area. The areas irradiated at the higher power level appeared to scatter light. Thus, the coatings were moistened with distilled water and dried before reading. The densities were measured with Status A filters, giving the following values.

| Power Used (Coating B) | | Status A Density Initial | After Laser | Δ |
|---|---|---|---|---|
| | R | 0.7 | 0.2 | −0.5 |
| 0.65 J/cm$^2$ | G | 1.8 | 0.3 | −1.5 |
| | B | 3.0 | 1.0 | −2.0 |
| | R | 0.7 | 1.1 | +0.4 |
| 0.24 J/cm$^2$ | G | 1.8 | 1.3 | −0.5 |
| | B | 3.0 | 2.5 | −0.5 |

EXAMPLE 3

This example describes the use of metastable aggregated-silver colloid coatings using a high-intensity xenon electronic flash lamp as a thermal energy source.

An aggregated-silver coating, B, was prepared as described in Example 1.

A Vivitar® Model 283 Electronic Flash Unit with a nominal output of 2,900 beam candle power seconds, a color temperature of 5500 degrees Kelvin, and an approximate flash duration of one millisecond, was used to expose the aggregated-silver coating. The flash exposures were made through 3 mm of glass which acted as a spacer. The resultant exposed area showed the following colors:

High: yellow to clear (near center of exposure area - directly under flashtube)

Low: green (near edges of exposure area)

A variation of the above imaging was made; a bar code pattern with associated printing was exposed onto the aggregated-silver coating using the following procedure. A copy on a transparent support of a bar code made on an Ektaprint Copier® was placed in contact with the coating and held in place with an open frame of a 4 mm thickness, having an aperture approximately the size of the flash unit lens. The flash unit was placed against the frame and the flash was activated. The exposure created a print of the bar code in various shades of green and yellow against a brown background which was judged of definition suitable for machine reading.

The invention has been disclosed above with regard to both general description and specific exemplification. The examples set forth are not limiting unless so indicated, and are intended only to further illustrate the invention and enhance the understanding of those of skill in the art. In particular, the skilled artisan will substitute various metals, electrolytes, and polymer matrices for those exemplified, without the exercise of inventive skill. The invention remains unlimited, save for the parameters of the claims appended hereto.

What is claimed as new and desired to be secured by Letters Patent of the United States is:

1. An element for forming a color-differentiated image comprising a support having thereon a metastable aggregated-metal colloid comprised of discrete aggregations of particles of silver dispersed in a polymeric matrix, said aggregates having a color different from that of said particles in non-aggregated form, wherein said aggregates deaggregate to individual particles on the application of thermal energy to said aggregated-metal colloid.

2. The metastable element of claim 1, wherein said polymeric matrix comprises a hydrophilic polymer.

3. The metastable element of claim 2, wherein said hydrophilic polymer is gelatin.

4. The metastable element of claim 3, wherein said gelatin is comprised of deionized bone gelatin.

5. The element of claim 1, wherein said support is a plastic film.

6. The element of claim 5, wherein said support is polyethylene terephthalate.

7. The element of claim 1, further comprising a subbing layer interposed between said support and said aggregated-metal colloid.

8. A method of preparing a stable color-differentiated image, comprising selectively applying thermal energy to portions of a layer of an element comprising a support having thereon a metastable aggregated-metal colloid comprised of discrete aggregations of particles of silver dispersed in a polymeric matrix, said aggregates having a color different from that of said particles in non-aggregated form thereby causing the portions of said layer exposed to thermal energy to change color.

9. The process of claim 8, wherein said selective application of thermal energy is achieved by application of a laser beam to said portions of said layer.

10. The process of claim 8, wherein said selective imaging is achieved by the passage of heat from a thermal printing head to said portions of said layer.

11. The process of claim 8, wherein said selective imaging is achieved by imagewise exposing said layer to a high intensity flash lamp.

12. The process of claim 8, said polymeric matrix comprises a hydrophilic polymer.

13. The process of claim 12, wherein said hydrophilic polymer is gelatin.

14. The process of claim 13, wherein said gelatin is comprised of deionized bone gelatin.

* * * * *